US009173467B2

(12) United States Patent
Passarello

(10) Patent No.: US 9,173,467 B2
(45) Date of Patent: Nov. 3, 2015

(54) HEADBAND WITH 360-DEGREE GLITTER PATTERN

(75) Inventor: Dari Passarello, New York, NY (US)

(73) Assignee: SPARKLY SOUL, INC., New York, NY (US)

( * ) Notice: Subject to any disclaimer, the term of this patent is extended or adjusted under 35 U.S.C. 154(b) by 0 days.

(21) Appl. No.: 13/978,391

(22) PCT Filed: Jul. 25, 2012

(86) PCT No.: PCT/US2012/048081

§ 371 (c)(1),
(2), (4) Date: Jul. 30, 2013

(87) PCT Pub. No.: WO2013/016394

PCT Pub. Date: Jan. 31, 2013

(65) Prior Publication Data

US 2013/0291887 A1 Nov. 7, 2013

Related U.S. Application Data

(60) Provisional application No. 61/512,696, filed on Jul. 28, 2011.

(51) Int. Cl.

| | |
|---|---|
| ***A45D 8/12*** | (2006.01) |
| ***A45D 8/36*** | (2006.01) |
| ***A41D 20/00*** | (2006.01) |
| *A45D 8/00* | (2006.01) |

(52) U.S. Cl.

CPC *A45D 8/36* (2013.01); *A41D 20/00* (2013.01); *A45D 8/00* (2013.01); *A45D 2008/004* (2013.01)

(58) Field of Classification Search

CPC ..... A41D 20/00; A45D 2008/004; A45D 2008/006; A45D 2008/002

USPC ..... 132/273, 275; 2/174

See application file for complete search history.

(56) References Cited

U.S. PATENT DOCUMENTS

| | | | | |
|---|---|---|---|---|
| 2,343,408 | A * | 3/1944 | Glass | 2/181 |
| 3,467,111 | A * | 9/1969 | Benson | 132/273 |
| 3,474,798 | A * | 10/1969 | Tillotson | 132/53 |
| 3,672,362 | A * | 6/1972 | Basche | 606/204.35 |
| 4,833,734 | A * | 5/1989 | Der Estephanian | 2/171 |
| 5,806,535 | A * | 9/1998 | Becker | 132/54 |
| 6,115,843 | A * | 9/2000 | Travalgia | 2/171 |
| 6,227,011 | B1 * | 5/2001 | Cortinovis | 66/171 |

(Continued)

FOREIGN PATENT DOCUMENTS

GB 2184754 A * 7/1987

*Primary Examiner* — Robyn Doan

(74) *Attorney, Agent, or Firm* — Jones Day

(57) ABSTRACT

A headband including an elastic glitter ribbon, a top portion of which forms the outside of the headband, where the elastic glitter ribbon has a 360-degree glitter pattern. The headband further includes a stretch velvet ribbon, a bottom portion of which forms the inside of the headband. The elastic glitter ribbon is attached to the stretch velvet ribbon using a stretch and stitch method. The ends of the elastic glitter ribbon and the stretch velvet ribbon are connected to form a 360-degree elastic headband, where the top of the elastic glitter ribbon includes material that sparkles, and where the bottom of the stretch velvet ribbon includes a velvet-like material that forms a gripping portion. The outside of the headband includes a 360-degree view of the sparkles with no break. The inside of the headband includes 360-degree gripping portion with no break.

14 Claims, 3 Drawing Sheets

(56) References Cited

U.S. PATENT DOCUMENTS 6,502,245 B1 * 1/2003 McBride ..... 2/181
D511,036 S * 11/2005 Moses ..... D2/894
2005/0061345 A1 * 3/2005 Srivastava ..... 132/200
2006/0042139 A1 * 3/2006 Mendes ..... 40/633
2009/0090378 A1 * 4/2009 Chudzik et al. ..... 132/273

* cited by examiner

HEADBAND WITH 360-DEGREE GLITTER PATTERN

CROSS-REFERENCE TO RELATED APPLICATIONS

This application is a national stage entry application of International Application No. PCT/US2012/048081, which was filed on Jul. 25, 2012, which claims priority to U.S. Provisional Patent Application No. 61/512,696, which was filed in the U.S. Patent and Trademark Office on Jul. 28, 2011.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

BACKGROUND OF THE INVENTION

1. Field of the Invention

The embodiments of the present invention relate generally to a headband that includes a 360-degree glitter pattern that has non-slip and non-snag properties.

2. Description of the Related Art

Headbands are widely used by a variety of people, including athletes and others with long hair, with one of the purposes of the headband being to keep hair out of the wearer's field of vision. Headbands are conventionally found in a variety of styles and are popular among girls and women.

Headbands may be made of various materials. The design of the headbands of the prior art have problems with slipping, causing hair snag, or creating a headache for the wearer. Some headbands are made from rigid materials and are oblong in shape with an opening at the bottom end to slide over the head of the wearer where each end fits behind the wearer's ear to secure itself in place by pressure behind the ear. These styles can often cause the wearer discomfort as pressure is felt from the point of contact behind the ears. Other headbands are adjustable, which are advertised as being comfortable and can be worn during strenuous activity. These adjustable headbands may include a rubber band or an elastic material which can slide off the wearer's head during strenuous activity. Alternatively, these headbands can be uncomfortably tight to securely stay on the head, which can cause the wearer to develop headaches.

Often, styles of headbands include a wraparound style headband that include a portion of a circular piece of elasticized material, which is secured in place by pressure from the elastic band as the elastic constricts around the head and hair of the wearer. These bands often slide off the wearer's head when used as a headband if they are not tightly fitted around the wearer's head. If a wraparound style headband does not include an elastic portion that has gripping properties, they tend to easily slide off a wearer's head.

Alternatively, many headbands of the prior art use a piece of black elastic to provide the "stretch" on the band, and do not have an elastic portion that wraps around the entire head—the band stops and the remainder is a plain elastic. While these headbands are marketed as "no slip," there is still a degree of slide due to the grip not going all the way around the band. These products cause a "headband headache" due to lack of elasticity.

There is a continuing unmet need for headbands comprising comfortable fabric which remain comfortable during prolonged wear and remain secure, as well as comfortable and stylish, during vigorous activity.

SUMMARY OF THE INVENTION

The embodiments of the present invention relate generally to a headband that includes non-slip and non-snag properties with a preferred 360-degree glitter pattern. For the reasons provided above, it is an object of the embodiments of the present invention to provide a headband that has 360-degree elasticity with superior grip to the headbands of the prior art. The improved grip and non-slip features of the embodiments of the present invention will allow for the headband to fit around a user's head without being too tight and causing a "headband headache." Additionally, it is an object of the present invention to provide a non-slip headband that will not snag in a wearer's hair. Moreover, it is an object of the present invention to provide an aesthetically appealing headband with a 360-degree glitter pattern, while providing the non-slip, non-snag features described herein.

The embodiments of the present invention include a headband including an elastic glitter ribbon, a top portion of which forms the outside of the headband, and where the elastic glitter ribbon has an elasticity and a 360-degree glitter pattern. The headband further includes a stretch velvet ribbon, a bottom portion of which forms the inside of the headband, and where the stretch velvet ribbon has an elasticity. The elastic glitter ribbon is attached to the stretch velvet ribbon using a stretch and stitch method, which maintains the elasticity of the elastic glitter ribbon and the stretch velvet ribbon. The ends of both the elastic glitter ribbon and the stretch velvet ribbon are connected to make the headband a 360-degree elastic headband, where the top portion of the elastic glitter ribbon includes material that sparkles, and where the bottom portion of the stretch velvet ribbon includes a velvet-like material that forms a gripping portion. The outside of the headband includes the top portion of the elastic glitter ribbon that gives the headband a 360-degree view of the sparkles with no break. The inside of the headband includes the bottom portion of the headband which forms the gripping portion that gives the headband a 360-degree gripping portion with no break.

Another embodiment of the present invention is directed to a headband including an elastic ribbon, a top portion of which forms the outside of the headband, and where the elastic ribbon has an elasticity. The headband further includes a stretch ribbon, a bottom portion of which forms the inside of the headband, and where the stretch ribbon has an elasticity. The elastic ribbon is attached to the stretch ribbon using a stretch and stitch method, which maintains the elasticity of the elastic ribbon and the stretch ribbon. Additionally, the ends of both the elastic ribbon and the stretch ribbon are connected to make the headband a 360-degree elastic headband. The bottom portion of the stretch ribbon includes a gripping portion, and the outside of the headband includes the top portion of the elastic ribbon which gives the headband a 360-degree view of the outside of the headband with no break. The inside of the headband includes the bottom portion of the headband which forms the gripping portion that gives the headband a 360-degree gripping portion with no break.

The embodiments of the present invention further include a headband including an elastic glitter ribbon, a top portion of which forms the outside of the headband and a bottom portion of which forms the inside of the headband. The elastic glitter ribbon has an elasticity and a 360-degree glitter pattern. Additionally, the ends of the elastic glitter ribbon are connected to make the headband a 360-degree elastic headband, where the top portion of the elastic glitter ribbon includes a material that sparkles, and where the bottom portion of the elastic glitter ribbon includes a silicone backing that forms a gripping portion. Further, the outside of the headband includes the top portion of the elastic glitter ribbon that gives the headband a 360-degree view of the sparkles with no break, and the inside of the headband includes the bottom portion of the elastic glitter ribbon including the silicone backing which forms the gripping portion that gives the headband a 360-degree gripping portion with no break.

BRIEF DESCRIPTION OF THE DRAWINGS

Preferred features of embodiments of the present invention are disclosed in the accompanying drawings, wherein similar reference characters denote similar elements throughout the several views, and wherein.

DETAILED DESCRIPTION

Figure 1:
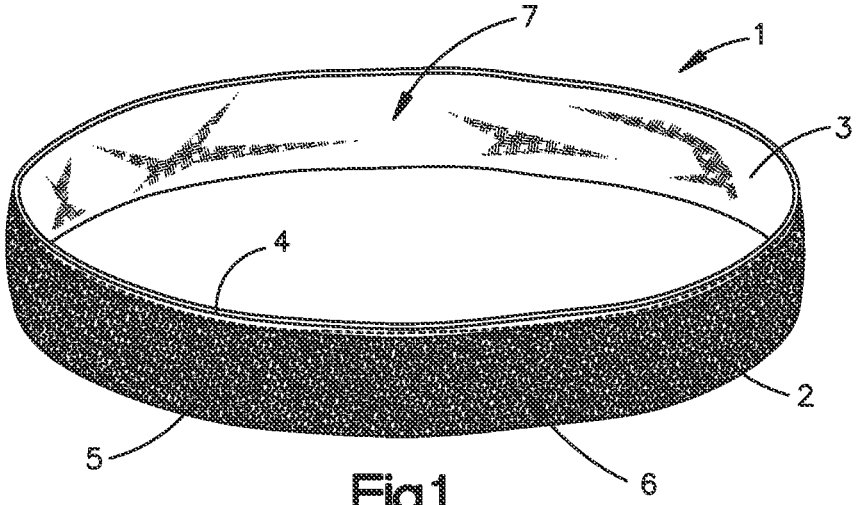
FIG. 1 is a top/side perspective view of a first embodiment of a headband with a 360-degree glitter pattern on the outside thereof.
Figure 2:
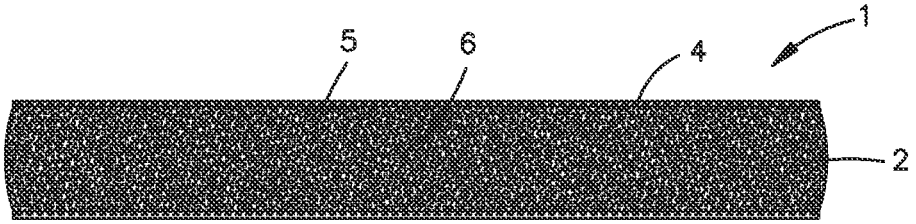
FIG. 2 is a front side view of a headband with a 360-degree glitter pattern as shown in FIG. 1.
Figure 3:
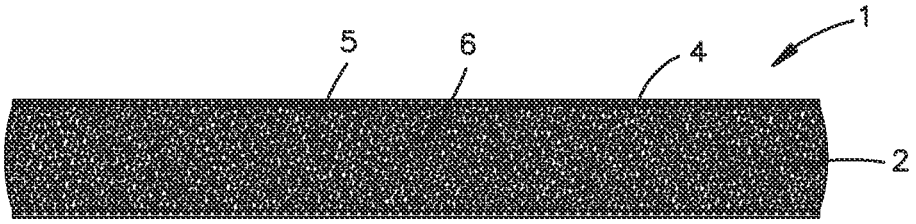
FIG. 3 is a rear side view of a headband with a 360-degree glitter pattern as shown in FIG. 1.
Figure 4:
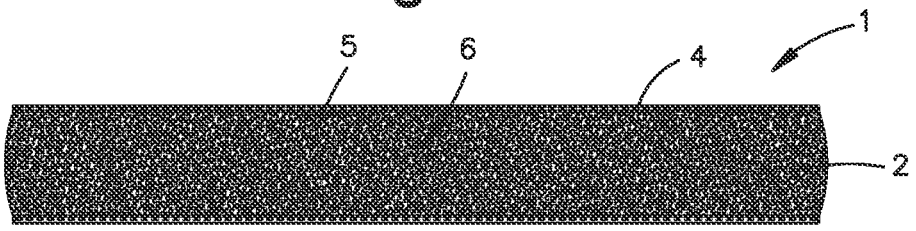
FIG. 4 is a left side view of a headband with a 360-degree glitter pattern as shown in FIG. 1.
Figure 5:
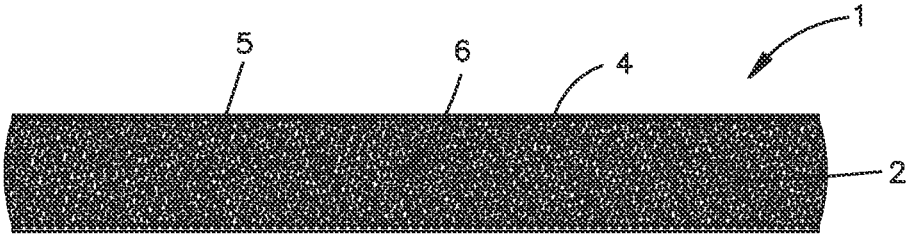
FIG. 5 is a right side view of a headband with a 360-degree glitter pattern as shown in FIG. 1.
Figure 6:
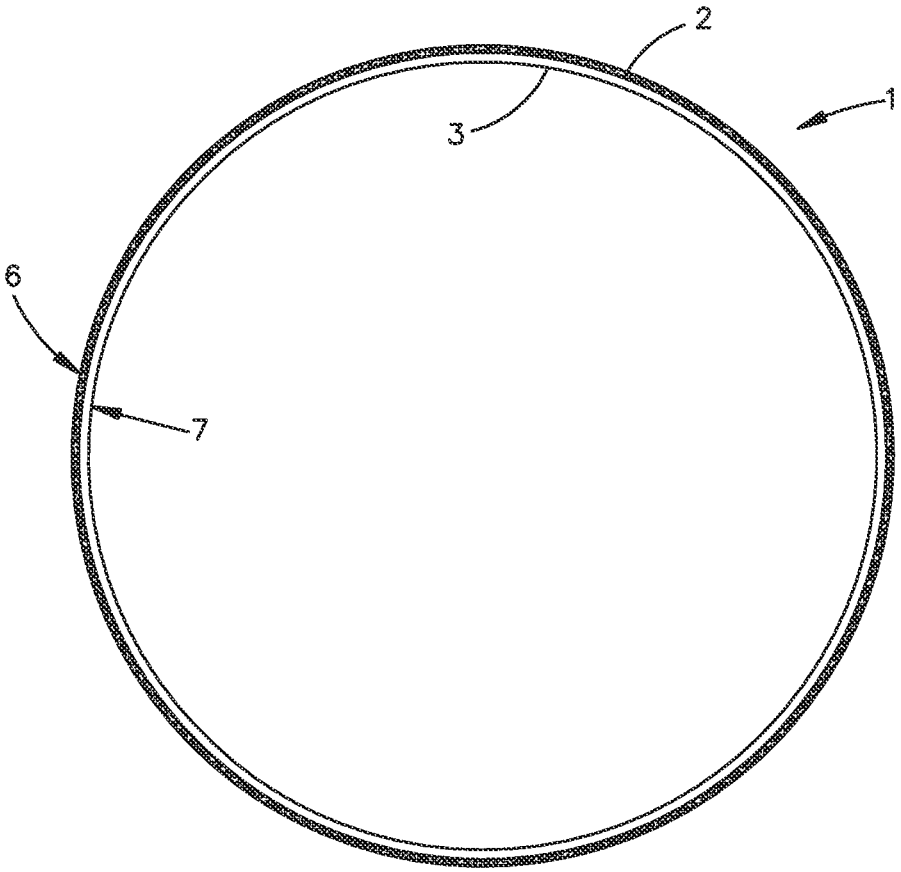
FIG. 6 is a top plan view of a headband with a 360-degree glitter pattern as shown in FIG. 1.
Figure 7:
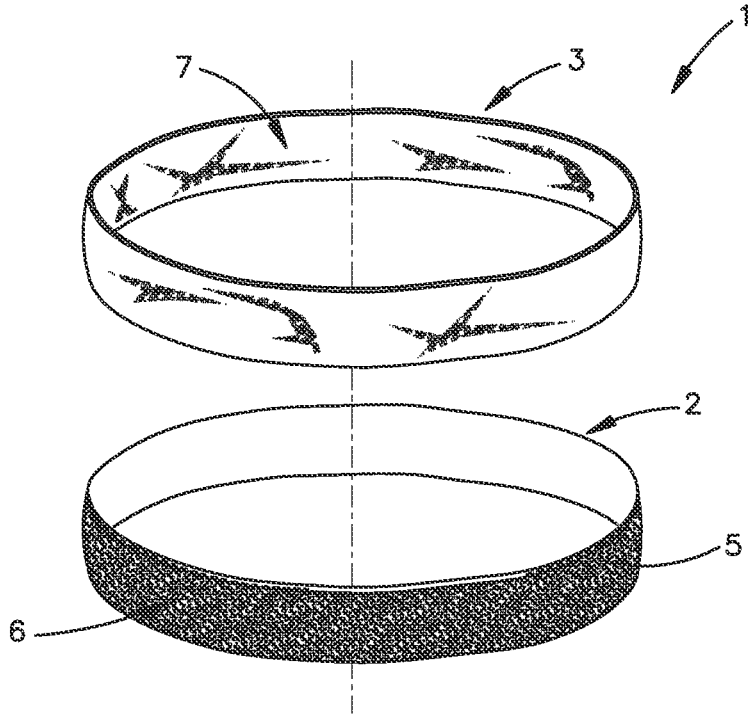
FIG. 7 is an exploded view of a headband with a 360-degree glitter pattern as shown in FIG. 1, showing the stretch velvet ribbon and the elastic glitter ribbon.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "upper," "lower," "inside," "outside" and the like, are words of convenience and are not to be construed as limiting terms.

Preferred features of the embodiments of the present invention are disclosed in the accompanying drawings. The figures filed herewith generally depict a headband that includes non-slip and non-snag properties with a preferred 360-degree glitter pattern. Specifically, the figures filed herewith show a headband that: improves grip on a wearer's head because of its non-slip features, prevents headband headaches, offers advantages in preventing snagging in a wearer's hair, and provides an aesthetically appealing headband with a preferred 360-degree glitter pattern, while providing the non-slip, non-snag features described herein.

As shown in the accompanying figures, the design for a non-slip, non-snag headband with a 360-degree glitter pattern of the embodiments of the present invention include a band with a 360-degree view of a glitter pattern with no "break" like other headbands known in the art. One of the characteristic features of the design of the headband of the present invention resides in the glitter pattern that completely encircles the headband. In the accompanying figures, the glitter pattern is shown as specks of black and white that encircle the entire headband on the outside thereof.

The embodiments of the present invention include a non-slip, non-snag headband that does not cause a headache and can withstand extreme conditions that may be experienced during running/exercising or the like. The headband of the embodiments of the present invention work from both a visual and utility perspective. The width of the headband in the embodiments of the present invention may vary. For example, in one embodiment of the present invention the width of the headband is ⅜-inch, and in a different embodiment of the present invention the width of the headband is ⅝-inch. However, one skilled in the art will readily understand that the sizes of the headband may vary from those specifically described herein and that the embodiments of the present invention are in no way limited to a certain size/width. Additionally, the embodiments of the present invention may be colored in numerous colors and color combinations.

As depicted in the figures, the headband 1 of an embodiment of the present invention is made from an elastic glitter ribbon 2 stitched onto a stretch velvet ribbon 3 using a stretch and stitch method. In the stretch and stitch method, both ribbons 2, 3 are stretched out and then stitched together, which maintains the elasticity of the two ribbons. The stretch and stitch method of joining the ribbons provides for the most reliability, durability, and visual appeal. If a standard stitch was used to join the two ribbons, the elasticity of the two ribbons would decrease or be taken away entirely. In an embodiment of the present invention, the stitch/thread 4 is visible on the outside of the headband 1. In another embodiment of the present invention, the stitch/thread is not visible on the outside of the headband.

After the elastic glitter ribbon 2 is stitched onto the stretch velvet ribbon 3 using the stretch and stitch method, the ends of both the elastic glitter ribbon 2 and the stretch velvet ribbon 3 are connected to make the outside of the headband 1 have a 360-degree view of the glitter 5 with no "break." The connection of the ends of the elastic glitter ribbon 2 and the stretch velvet ribbon 3 may be through the stitching together of the ends or the like, or through any means known in the art for connecting the ends of material for making headbands.

In the embodiments of the present invention, the outside surface 6 of the headband 1 sparkles because it is covered in glitter 5, which can be achieved in a variety of ways. In an embodiment of the present invention, the glitter 5 is adhered to the elastic glitter ribbon 2. In other embodiments of the present invention, the glitter 5 is integral with the elastic glitter ribbon 2. The glitter 5 may be integral with the elastic glitter ribbon 2, for example, by the attachment of small tinsel-like strands that shimmer and sparkle when light reflects off of the surface of the strands. The strands, as opposed to the glitter adhered to the elastic glitter ribbon 2, give the elastic glitter ribbon 2 a soft feel. Additionally, these tinsel-like strands are not as easily disconnected from the headband as typical pieces of glitter, which is desirable because the wearer of the headband 1 typically does not want glitter on their hair/body/clothes. Thus, in an embodiment of the present invention, the elastic glitter ribbon 2 is soft and sparkly, and does not shed glitter. The elastic glitter ribbon 2 may be a variety of colors and a variety of sizes.

The bottom surface of the stretch velvet ribbon 3 forms the inside surface 7 of the headband 1. In an embodiment of the present invention, the bottom surface of the stretch velvet ribbon 3 is made of a velvet material. The velvet bottom prevents slipping and snagging (i.e., hair pulling) on a wearer's head. Additionally, the velvet inside surface 7 of the headband 1 creates a comfortable feel on a wearer's head so as not to cause a headband headache. If the velvet bottom surface of the stretch velvet ribbon 3 was not present in an embodiment of the present invention, any plain ribbon (elastic or not) would slip right off a wearer's head. This is because the velvet material acts to grip the hair, without snagging the hair of a wearer. This is especially true when exercising.

In an embodiment of the present invention, the stretch velvet ribbon 3 is lush with a resplendent look and is woven with the elasticity required for the headband 1 of the embodiments of the present invention. The stretch velvet ribbon 3 may be a variety of colors and a variety of sizes. In an embodiment of the present invention the stretch velvet ribbon 3 is made of approximately 80% nylon and approximately 20% elastomer (a person of ordinary skill in the art would under that "approximately" used in this context means "within a few percentage points"). However, one skilled in the art will understand that the embodiments of the present invention are not limited to the materials described herein for either the elastic glitter ribbon 2 or the stretch velvet ribbon 3.

Moreover, the elastic properties of the headband 1 of the embodiments of the present invention prevent headband headaches because the fit of the headband 1 is not too tight and the headband 1 does not have a limited flexibility. The headband 1 of the embodiments of the present invention molds to a wearer's head because the headband 1 encircles the entire head with no break.

The embodiments of the present invention provide for the most functionality and highest level of visual appeal. In other embodiments of the present invention the elastic glitter ribbon 2 may be replaced with an elastic ribbon that includes, but is not limited to, various textured ribbons, fabrics, and fasteners including but not limited to sequins, spandex, polyester blends, beading, silicone, toggles, tapes, buttons, hooks, sliders, Velcro, gimp, and/or puff paint.

The embodiments of the present invention are improvements from the headbands of the prior art. For example, many similar prior art headbands do not stretch for 360-degrees of the headband—they use a piece of black elastic on the back of the headband to provide the "stretch" on the headband. Additionally, the gripping portion of prior art headbands does not wrap around the entire head of the wearer—the headband stops and the remainder is plain elastic. While most of the headbands of the prior art market their headbands as "no slip," there is still a degree of slide due to the grip not going all the way around the headband, and therefore not going all the way around the wearer's head. These headbands of the prior art cause a headband headache due to their lack of elasticity.

In an alternative embodiment of the present invention, the stretch velvet ribbon 3 is substituted for a stretch silicone backing. In an embodiment of the present invention, the stretch silicone backing is an elastic band with silicone applied to its bottom surface (the surface that will contact the wearer's head while in use).

In another embodiment of the present invention, the stretch velvet ribbon 3 is eliminated entirely, and silicone backing is attached directly to the elastic glitter ribbon 2. The silicone backing may cover the entire back of the elastic glitter ribbon 2, or it may be applied only to a section of the back of the elastic glitter ribbon 2. For example, the silicone backing may only be a strip of silicone down the middle of the ribbon.

As discussed above, the embodiments of the present invention may be manufactured in many different colors and/or color combinations. For example, in an embodiment of the present invention, the elastic glitter ribbon 2 and the stretch velvet ribbon 3 may be color coordinated, and in another embodiment they may be different colors.

In another embodiment of the present invention, the elastic glitter ribbon 2 is substituted for an elastic ribbon that contains no glitter.

In an embodiment of the present invention, the headband does not have limited flexibility.

The embodiments of the present invention are intended for use by all sexes and ages. The embodiments of the present invention may be used while exercising, for general comfort, or as a fashion accessory. The embodiments of the present invention may be used as a device to keep hair out of a wearer's face/eyes, as a sweatband, or for any other purposes a person might wear a headband.

It is understood to one skilled in the art that although the headbands 1 of the embodiments of the present invention are preferably situated for use as a human headband, there may be other alternative uses. For example, the headbands 1 of the embodiments of the present invention may be used as leashes or collars for animals such as dogs or cats.

Figure 8:
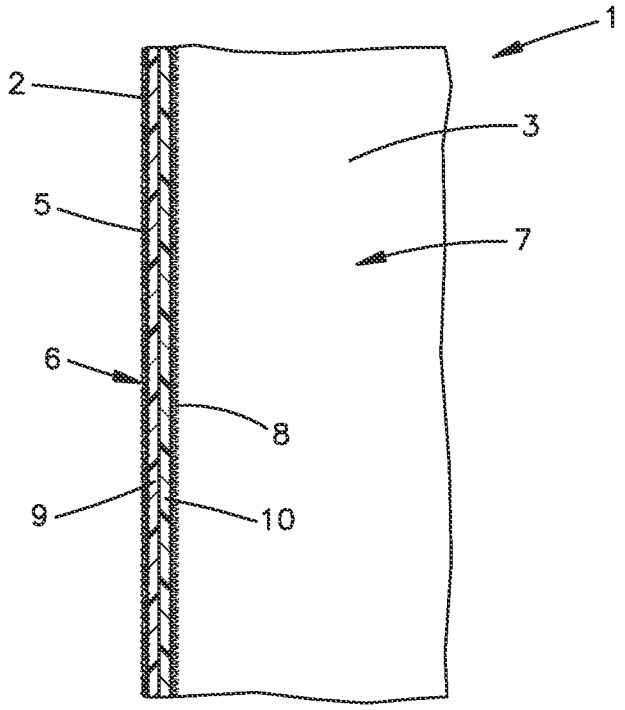
FIG. 8 is a cross-sectional view of a headband with a 360-degree glitter pattern.

FIG. 8 depicts a cross-sectional view of a headband 1 according to an embodiment of the present invention. As depicted in FIG. 8, the elastic glitter ribbon 2 and the stretch velvet ribbon 3 include at least two layers, where the outside layer of the elastic glitter ribbon 2 corresponds to the outside surface 6 of the headband and the outside layer of the stretch velvet ribbon 3 corresponds to the inside surface 7 of the headband 1. The outside layer of the elastic glitter ribbon 2 includes the glitter 5, which encircles the entire outside surface 6 of the headband 1 in an embodiment of the present invention. The outside layer of the stretch velvet ribbon 3 includes a velvet-like material 8, which encircles the entire inside surface 7 of the headband 1 in an embodiment of the present invention. The inside layer of the elastic glitter ribbon 2 includes an elastic material 9 or the like, such that the elastic glitter ribbon 2 has elastic properties in an embodiment of the present invention. Similarly, the inside layer of the stretch velvet ribbon 3 includes an elastic material 10 or the like, such that the stretch velvet ribbon 3 has elastic properties in an embodiment of the present invention.

I claim:

1. A headband consisting of:

a. an elastic glitter ribbon, a top portion of which forms the outside of the headband, wherein the elastic glitter ribbon has an elasticity and a 360-degree glitter pattern;

b. a stretch velvet ribbon, a bottom portion of which forms the inside of the headband, wherein the stretch velvet ribbon has an elasticity, c. wherein the elastic glitter ribbon is attached to the stretch velvet ribbon using a stretch and stitch method, which maintains the elasticity of the elastic glitter ribbon and the stretch velvet ribbon, d. wherein the ends of both the elastic glitter ribbon and the stretch velvet ribbon are connected to make the headband a 360-degree elastic headband, e. wherein the top portion of the elastic glitter ribbon comprises material that sparkles, f. wherein the bottom portion of the stretch velvet ribbon comprises a velvet-like material that forms a gripping portion, g. wherein the outside of the headband comprises the top portion of the elastic glitter ribbon that gives the headband a 360-degree view of the sparkles with no break, and h. wherein the inside of the headband comprises the bottom portion of the headband which forms the gripping portion that gives the headband a 360-degree gripping portion with no break.

2. The headband according to claim 1, wherein the headband has a width of ⅜-inch.

3. The headband according to claim 1, wherein the headband has a width of ⅝-inch.

4. The headband according to claim 1, wherein the stretch and stitch method that attaches the elastic glitter ribbon to the stretch velvet ribbon yields a visible stitch/thread on the outside of the elastic glitter ribbon.

5. The headband according to claim 1, wherein the stretch and stitch method that attaches the elastic glitter ribbon to the stretch velvet ribbon does not yield a visible stitch/thread on the outside of the elastic glitter ribbon.

6. The headband according to claim 1, wherein the elastic glitter ribbon further comprises glitter adhered to the elastic glitter ribbon.

7. The headband according to claim 1, wherein the elastic glitter ribbon further comprises glitter that is integral with the elastic glitter ribbon.

8. The headband according to claim 7, wherein the glitter is integral with the elastic glitter ribbon by the attachment of small tinsel-like strands that shimmer and sparkle when light reflects off of the surface of the strands.

9. The headband according to claim 7, wherein the elastic glitter ribbon is soft and sparkly, and does not shed glitter.

10. The headband according to claim 1, wherein the velvet-like material that forms a gripping portion is comprised of nylon and elastomer.

11. The headband according to claim 1, wherein the elastic glitter ribbon and the velvet stretch ribbon are the same color.

12. The headband according to claim 1, wherein the elastic glitter ribbon and the velvet stretch ribbon are a different color.

13. A headband consisting of:

a. an elastic glitter ribbon, a top portion of which forms the outside of the headband and a bottom portion of which forms the inside of the headband, wherein the elastic glitter ribbon has an elasticity and a 360-degree glitter pattern;

b. wherein the ends of the elastic glitter ribbon are connected to make the headband a 360-degree elastic headband, c. wherein the top portion of the elastic glitter ribbon comprises material that sparkles, d. wherein the bottom portion of the elastic glitter ribbon comprises a stretch velvet that forms a gripping portion, e. wherein the outside of the headband comprises the top portion of the elastic glitter ribbon that gives the headband a 360-degree view of the sparkles with no break, and f. wherein the inside of the headband comprises the bottom portion of the elastic glitter ribbon comprising the stretch velvet which forms the gripping portion that gives the headband a 360-degree gripping portion with no break.

14. The headband according to claim 13, wherein the stretch velvet covers the entire back of the elastic glitter ribbon.

* * * * *